US006109443A

United States Patent [19]

Dercole

[11] Patent Number: 6,109,443

[45] Date of Patent: Aug. 29, 2000

[54] COSMETIC SALES CARRYING CASE AND METHOD

[76] Inventor: Bonnie Lee Dercole, 1122 Byrd St., Edisto Beach, S.C. 29438

[21] Appl. No.: 09/386,967

[22] Filed: Aug. 31, 1999

[51] Int. Cl.[7] ..... B65D 69/00; A45D 27/22; A45C 13/00

[52] U.S. Cl. ..... 206/581; 132/315; 150/112; 190/109; 190/117

[58] Field of Search ..... 206/581; 132/315; 150/112, 115–117; 190/16, 17, 109, 115, 117

[56] References Cited

U.S. PATENT DOCUMENTS

| | | | |
|---|---|---|---|
| 1,266,091 | 5/1918 | Basch | 206/581 |
| 1,281,296 | 10/1918 | Coen | 206/581 |
| 2,623,566 | 12/1952 | Kibler | 206/581 X |
| 4,566,130 | 1/1986 | Coates | 190/117 X |
| 5,255,835 | 10/1993 | Burks | 150/112 X |
| 5,394,964 | 3/1995 | White | 190/109 X |
| 5,699,886 | 12/1997 | Latshaw | 190/115 X |

*Primary Examiner*—Bryon P. Gehman
*Attorney, Agent, or Firm*—Ralph Bailey, P.A.

[57] ABSTRACT

A cosmetic carrying case constructed of flexible material is compartmentalized to provide a first and second compartments (A and B), respectively for containing a foldable auxiliary compartment (C) therebetween with end flaps (D) closed by the zippers (E). The compartments may be opened in flat configuration for visual display and folded and zipped closed. The entire contents of the carrying case are protected from extreme temperatures by sheet insulating material as well as a foil thermal barrier.

11 Claims, 6 Drawing Sheets

COSMETIC SALES CARRYING CASE AND METHOD

BACKGROUND OF THE INVENTION

This invention relates to a carrying case for assembling cosmetic products in an organized fashion for transport, display and delivery. The case is constructed of flexible material in at least three compartments which may be readily opened for display and folded together for closure and transport.

Various flexible carrying cases have been provided wherein compartmentalized storage compartments and pockets facilitate arranging and visually displaying a variety of cosmetic products in a single carrying case. Carrying cases of this type have been limited as to the variety and quantity of cosmetics which may be assembled for display in a single carrier. It is for this reason that cosmetic organizers have been largely constructed in rigid cases as exemplified by U.S. Pat. Nos. 4,717,024, 5,211,302, 5,301,808, and 5,358,100. This invention is concerned with providing a flexible carrier which is compartmentalized for arranging a wide variety of cosmetics and accessories for display, and which may be easily folded together for transport. Compartments are provided for separating the various cosmetics and accessories for assembly in such a way that a single carrying case is arranged for easy closure for affectively containing the products for carrying and display to a customer or customers so that only one case is required for displaying an entire line of products and for dispensing articles therefrom which have been sold to customers.

It is especially important to protect cosmetic products from temperature extremes. When cosmetics are stored in carrying cases the contents are vulnerable to temperature changes due to exposure to the elements when moved from one location to another. It is an important object of this invention to construct a versatile carrying and display case which provides protection of the contents from temperature extremes.

SUMMARY OF THE INVENTION

Accordingly, it is an important object of this invention to provide a carrying case constructed of flexible material in such a way that a number of compartments or sections may be folded together with at least one compartment sandwiched between outer compartments which may be closed thereupon securing their contents as well as the contents of the intermediate compartment in a single carrier.

Another important object of the invention is to provide a single carrying case which may be transported for conveying the cosmetic products which have been assembled therein in an organized fashion and which may be quickly opened and unfolded in such a way as to display most or all of the products in an array such as to affectively display all of the products at one time.

The method contemplates carrying and displaying cosmetics utilizing first and second foldably connected compartments for displaying cosmetics carried therein and foldably connecting at least one other compartment to an end of the second compartment so that by joining the opposed ends of the first and second compartments a complete carrying case may be readily assembled and unfolded for display.

Another important part of the invention is accomplished by providing a sheet of insulation over the entire container and its contents which together with a thermal barrier constructed of gold foil and the like protects the entire contents from temperature extremes. Many cosmetic products such as lipsticks melt and are particularly adversely affected by excessive heat.

While the carrying case and method is especially useful for displaying and demonstrating cosmetics as well as dispensing them to customers the construction and method may be utilized for carrying other articles.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A cosmetic sales carrying case including a first compartment A having a first base with a first handle fastened on an outside surface adjacent to an end of the first base. A second compartment B, having a second base with a second handle fastened on an outside surface thereof adjacent to an end remote from the first base and being foldably carried adjacent to the other end of the first base. At least one other compartment C foldably carried adjacent to the remote end of the second compartment. Marginal flaps D at respective opposed sides of the first and second compartments. A fastener E on each of the flaps for disconnectably joining adjacent flaps with the other compartment folded over the second compartment and sandwiched between the first and second compartments during transport. Thus, the first and second handles are in position to facilitate carrying by a user.

The method of carrying and displaying cosmetics includes the steps of utilizing first and second compartments A and B foldably connected at adjacent ends for displaying cosmetics therein. Foldably connecting at least one other compartment C to the free end of the second compartment; and joining the first and second foldable compartments at adjacent sides securing each side of said first and second compartments forming a closed carrying case with the other compartment sandwiched between the first and second compartments.

Figure 5:
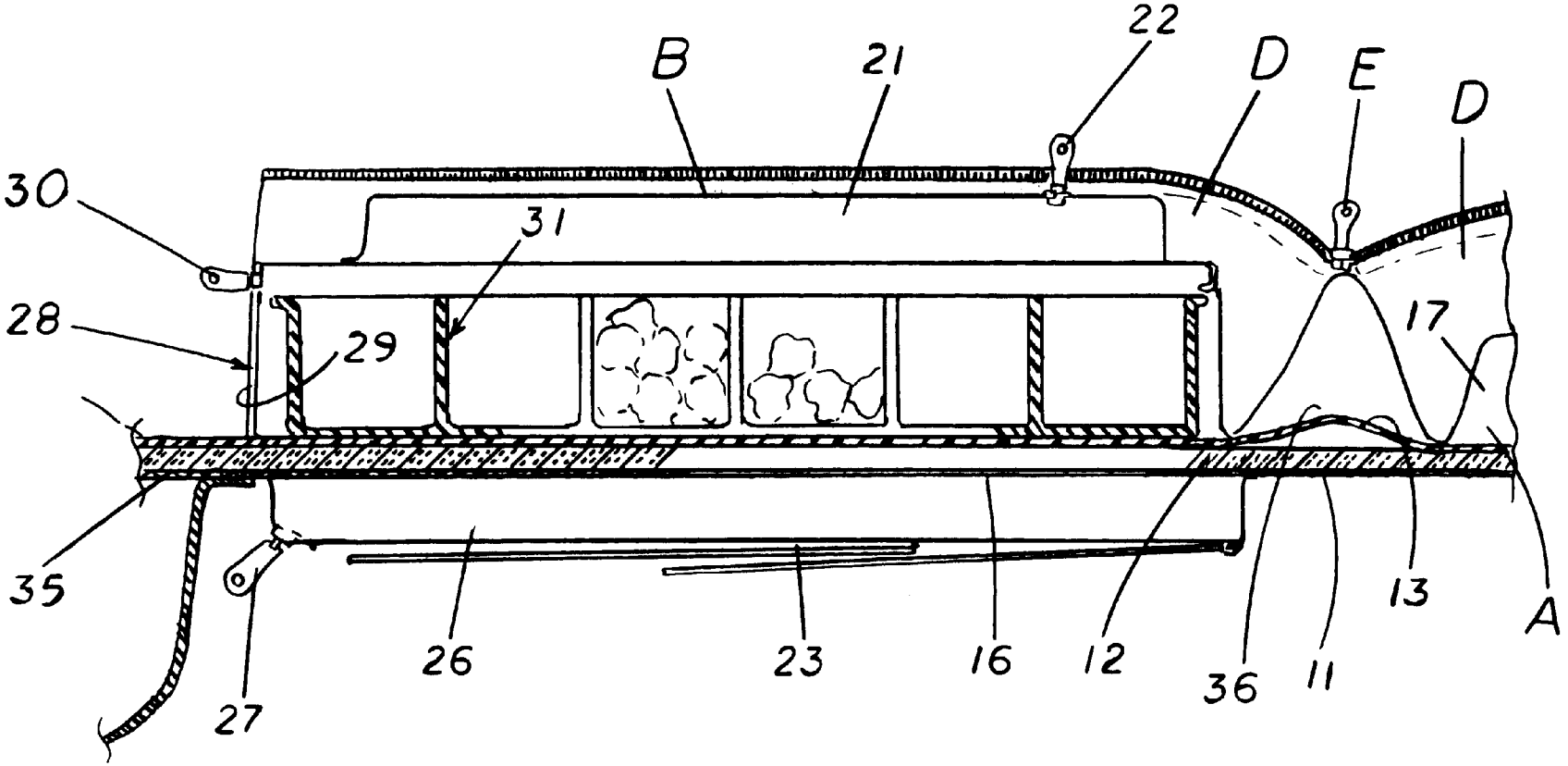
FIG. 5 is an enlarged sectional elevation taken on the line 5—5 in FIG. 3 illustrating the second or intermediate compartment and the foldable connections for attachment of the first and auxiliary compartments thereto.
Figure 6:
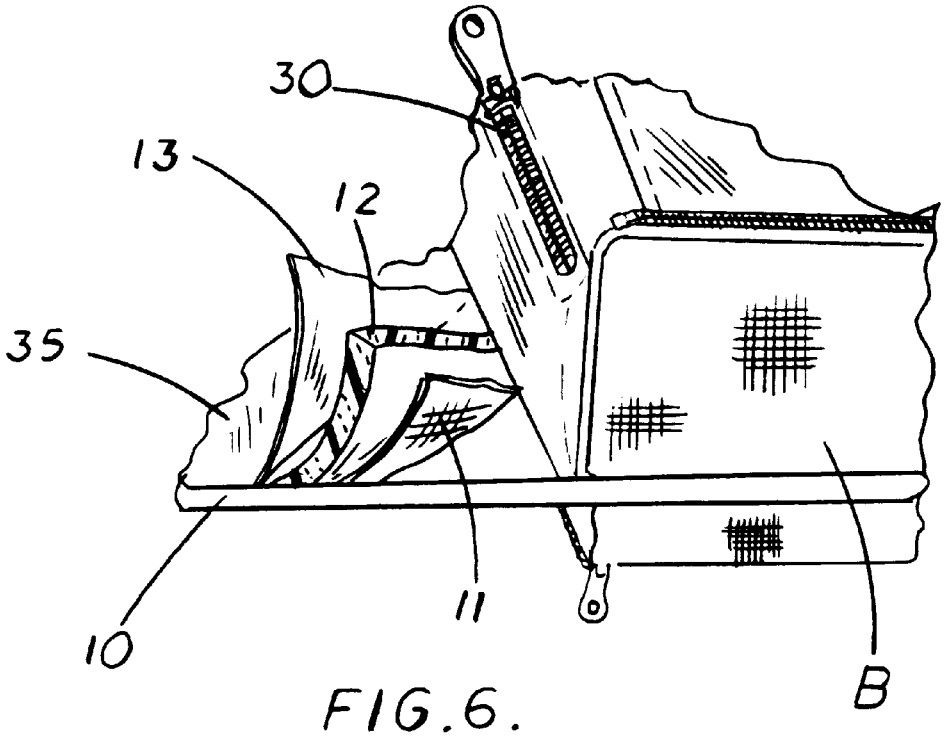
FIG. 6 is a perspective view looking toward the top of the intermediate compartment and further illustrating the foldable connection with an auxiliary compartment.
Figure 7:
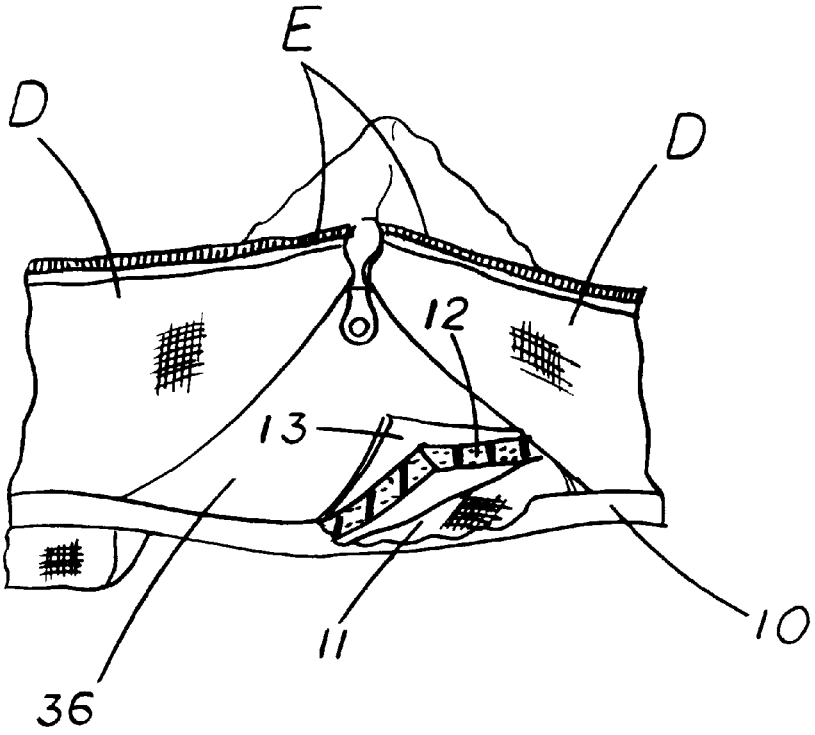
FIG. 7 is a perspective view illustrating the closure end flaps and zippered connections for closing each of the component compartments into a single case for loading and unloading for display.

Referring more particularly to FIGS. 3–7 a first compartment A is illustrated as having a base broadly designated as at 10. The base 10 includes an outside component of black nylon sheet material 11 which is of waterproof construction. The fabric is best illustrated in FIG. 5 as extending and forming part of a base for the second or intermediate compartment B as well as the auxiliary compartment C. The base 10 further includes a sheet of insulation 12 which also extends the entire length of the assembled compartments forming the carrying case. A foil insulating barrier 13 is carried above the insulation 12 and extends entirely there across throughout the length of the assembly.

The first compartment A carries a flexible strap 14 connected at each end to the back of the base 10 and extending a suitable length for being utilized in conjunction with a complimentary strap 15 carried by the base segment 15 which extends beneath the second or intermediate compartment B. Thus, the compartments A and B form the outside components of the assembled carrying case as noted in closed configuration in FIGS. 1 and 2. The compartment A further has transverse first compartments 17 and 18 constructed of transparent materials which are provided with zippers 19 and 20, respectively. These compartments provide pockets consisting essentially of clear vinyl material for viewing nail care products and lipsticks, respectively, or any other desired cosmetic or accessory product.

Figure 1:
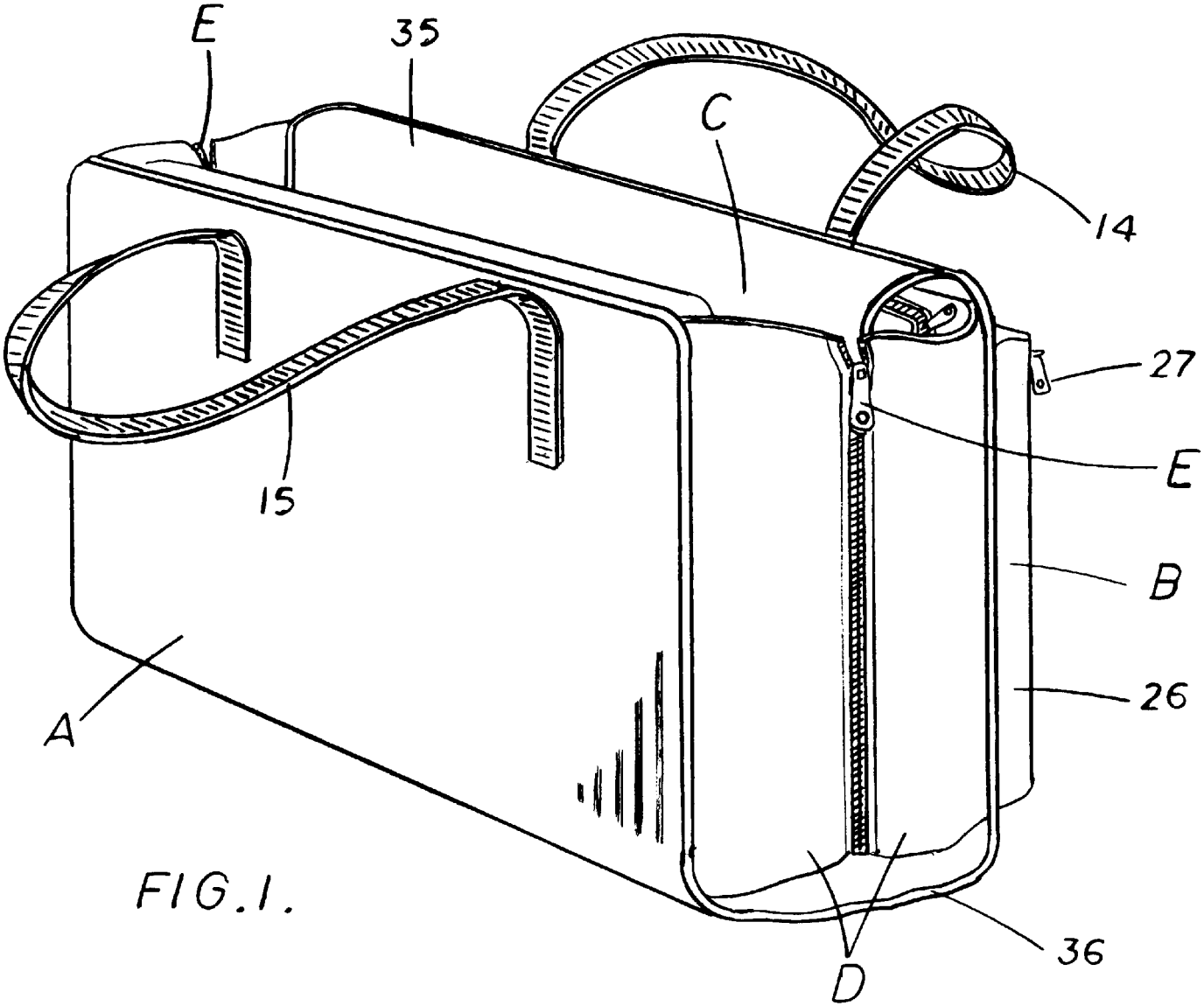
FIG. 1 is a front perspective view illustrating a foldable cosmetic carrying case constructed in accordance with the invention wherein the components may be readily unfolded for simultaneously displaying the contents of the carrying case. An auxiliary compartment is illustrated as being foldably connected on one end of an intermediate compartment for folding and being sandwiched between front and intermediate compartments.
Figure 2:
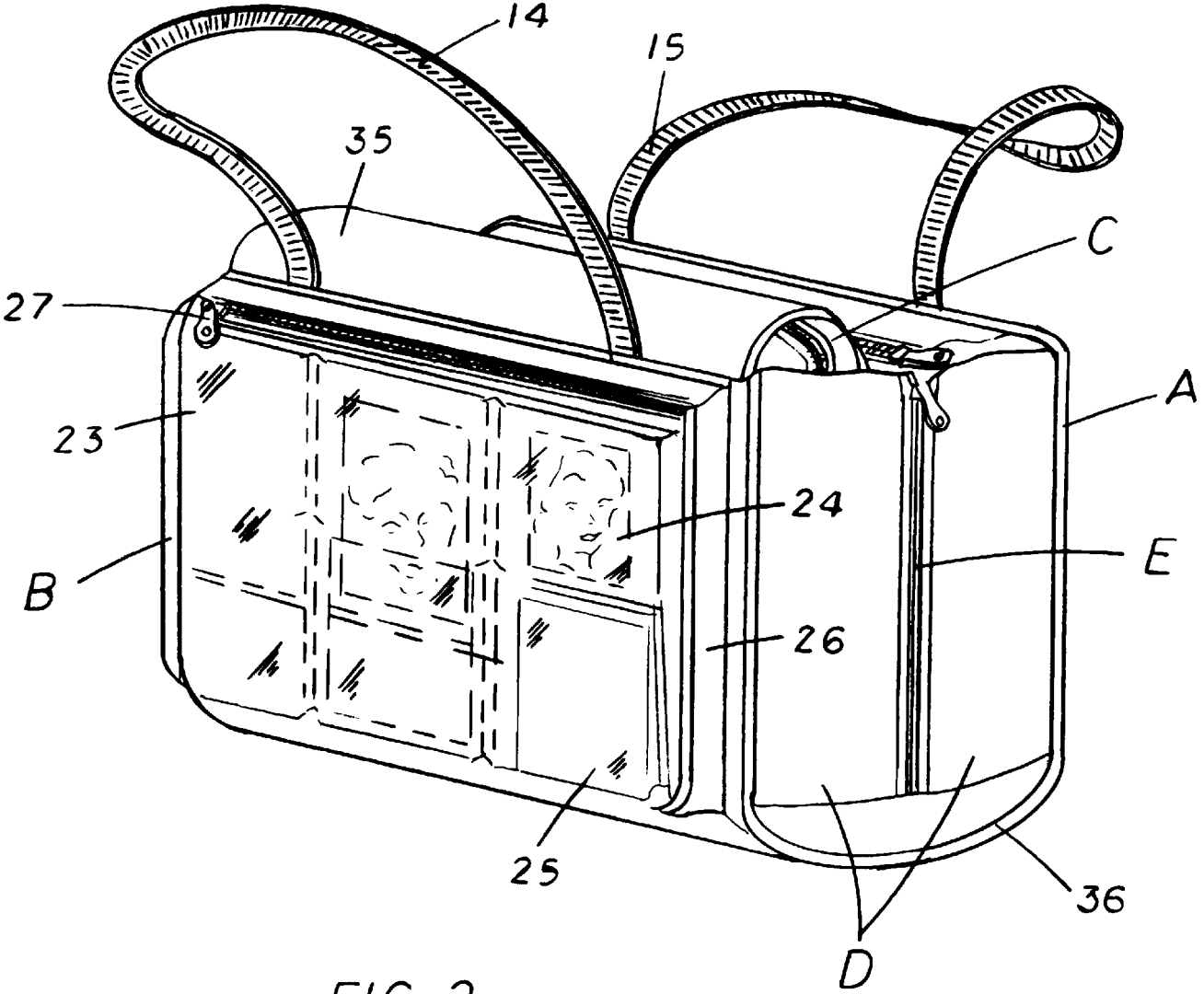
FIG. 2 is a rear perspective view further illustrating the cosmetic carrying case of FIG. 1 wherein a zippered outside compartment is carried on a back surface of the intermediate compartment.
Figure 3:
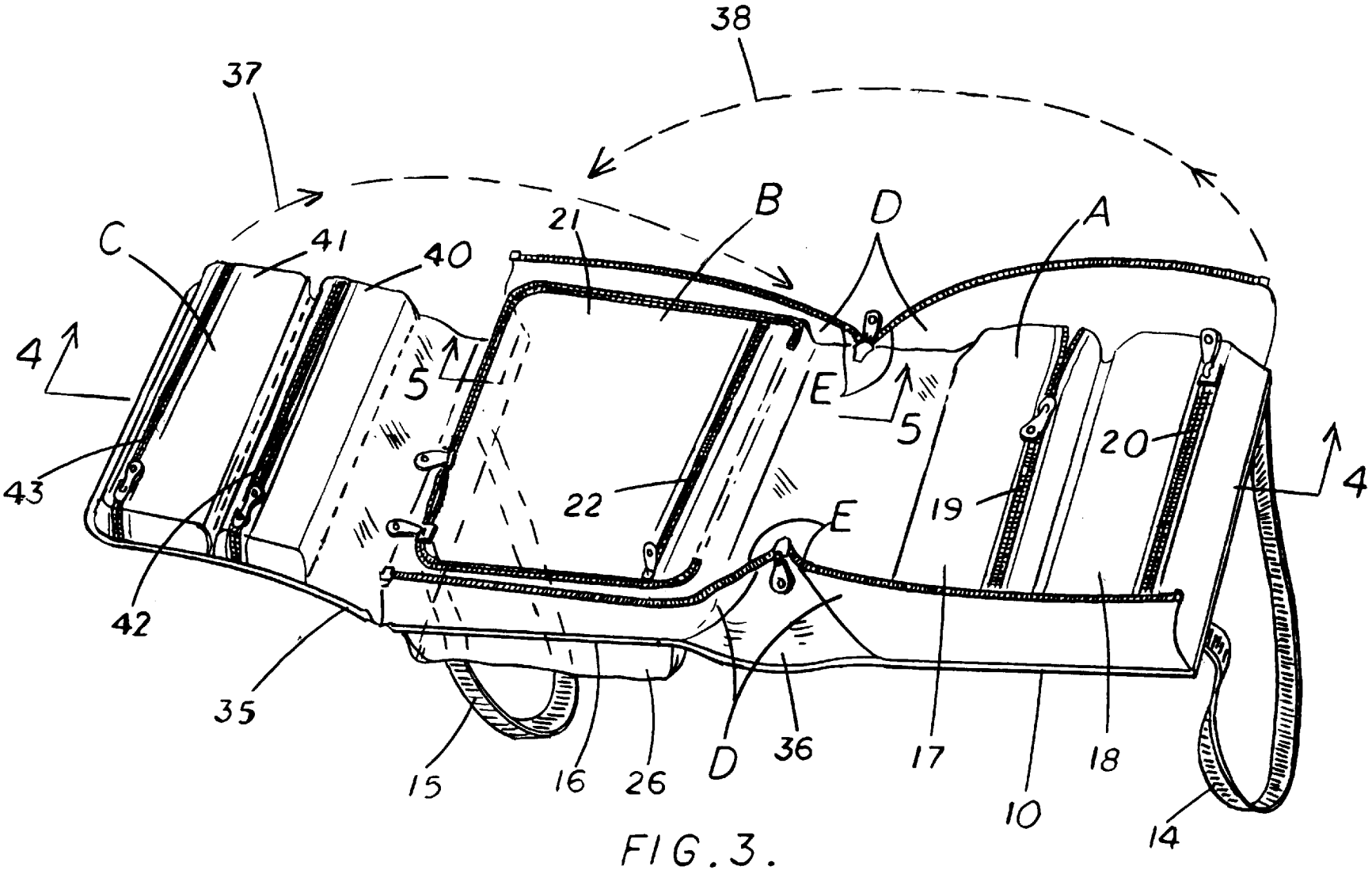
FIG. 3 is a top perspective view illustrating first and second compartments as well as a third auxiliary compartment, each in opened configuration for displaying the contents through transparent pockets which may be zippered for carrying and separating a variety of cosmetic products for visual display.
Figure 4:
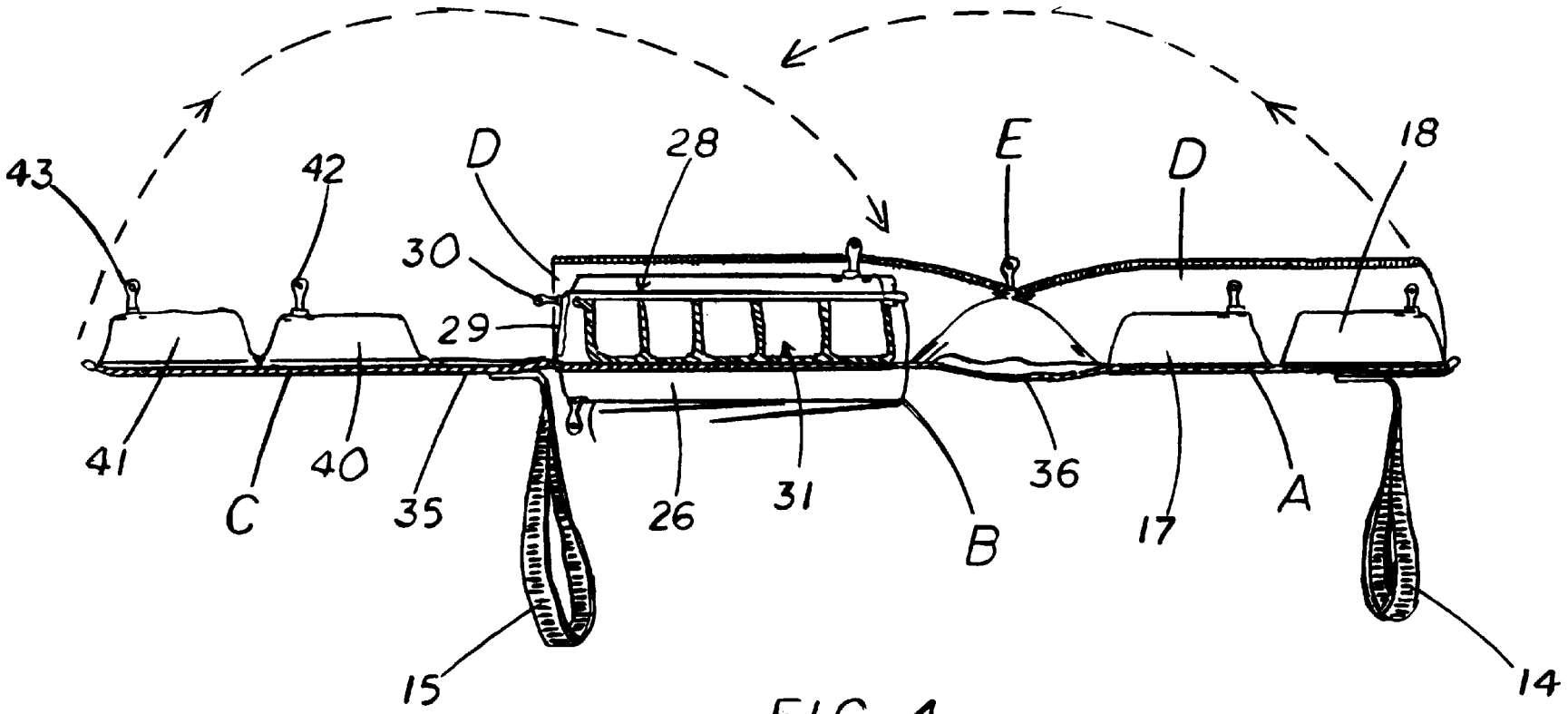
FIG. 4 is a longitudinal sectional elevation taken on the line 4—4 in FIG. 3.

The intermediate compartment B is also provided with a clear vinyl compartment 21 having a zipper 22. The intermediate compartment 21 is specially sized to contain and display elongated articles such as eyeliner pencils, for example. It is important to note in FIG. 5 that transparent pockets 23 have been provided for containing flat items such as photographs and notepads 24 and 25, respectively, as illustrated in FIG. 2. Other flat accessories may be contained in a compartment 26 having a zipper 27. An intermediate compartment broadly designated at 28 has vertical sides 29 carried supporting the compartment 21. A zipper 30 provides an opening for inserting and removing a compartmentalized tray broadly designated as at 31. The first and second components A and B at their respective sides are provided with marginal flaps D and a zipper E which extends about each of the respective edges of the flaps, E as illustrated in FIGS. 1 and 2 for containing the other compartment C in sandwiched fashion therebetween. The zipper is illustrated in open position in FIGS. 2–5 adjacent the foldable connection between compartments A and B.

Referring again to FIG. 3, the other or auxiliary compartment C is suitably hinged as at 35 by a foldable connection of the flexible base member 10 in similar fashion to the connecting portion 36 which joins the compartments A and B. The compartment C may be conveniently folded first over the intermediate compartment as indicated by the arrow 37. This assembly may thereupon be folded, as indicated by the arrow 38 over the compartment A preparatory to closure by the zippers E.

Referring again to the auxiliary compartment C, it will be noted that a pair of transverse receptacles 40 and 41 are constructed of suitable transparent material for displaying specialized articles of cosmetics such as additional lipsticks and nail care products as previously described in connection with compartments 17 and 18 within the first compartment A. Suitable zippers 42 and 43, respectively, are provided for assuring containment of a predetermined number of cosmetic articles of a given kind therein.

While a preferred embodiment of the invention has been described using specific terms, such description is for illustrative purposes only, and it is to be understood that changes and variations may be made without departing from the spirit or scope of the following claims.

What is claimed is:

1. A cosmetic sales carrying case comprising:

a plurality of foldable compartments including a first compartment having a first base with a first handle fastened on an outside surface adjacent to an end of the first base;

a second compartment, having a second base with a second handle fastened on an outside surface thereof adjacent to an end remote from the first base and being foldably carried adjacent to the other end of the first base;

at least one other compartment foldably carried adjacent to said remote end of the second compartment;

marginal flaps at respective opposed sides of the first and second compartments; and a fastener on each of the flaps for disconnectably joining adjacent flaps with at least one other compartment folded over the second compartment and sandwiched between the first and second compartments during transport;

whereby the first and second handles are in position to facilitate carrying by a user.

2. The cosmetic sales carrying case set forth in claim 1 including a flexible insulation layer, a foil temperature barrier, and a flexible plastic exterior sheet extending across said compartments forming first and second bases, and foldable connections therebetween.

3. The cosmetic sales carrying cases set forth in claim 2 wherein the fasteners are zippers for disconnectably forming the first and second compartments.

4. The cosmetic sales carrying case set forth in claim 3 including a zippered central compartment having sides providing sufficient depth for containing a compartmentalized tray.

5. The cosmetic sales carrying case set forth in claim 4 wherein at least one central compartment further includes vinyl interior and exterior pockets.

6. The cosmetic sales carrying case set forth in claim 5 including an exterior pocket for storing flat articles between a vinyl exterior pocket and at least one central compartment for containing a tray.

7. A sales organizer for demonstrating and delivering cosmetics comprising:

a first compartment having a first base;

a second compartment having a second base foldably carried adjacent to an end of the first base;

at least one other compartment foldably carried adjacent to a free end of the second compartment;

marginal flaps at respective opposed sides of the first and second compartments; and a fastener on each of the flaps for disconnectably joining adjacent flaps with at least one other compartment folded over the second compartment and sandwiched between the first and second compartments during transport;

whereby the compartments may be opened to a flat configuration for cosmetic display and delivery, and folded in superposed closed position for transport with at least one other compartment sandwiched between the first and second compartments for transport.

8. A method of carrying and displaying cosmetics comprising the steps of:

utilizing first and second compartments foldably connected at adjacent ends for displaying cosmetics therein;

foldably connecting at least one other compartment to a free end of the second compartment; and joining respective sides of the first and second foldable compartments forming a closed carrying case with at least one other compartment sandwiched between the first and second compartments.

9. The method of carrying and displaying cosmetics set forth in claim 8 including the steps of providing an insulation layer and a foil temperature barrier extending continuously across the compartments; and unfastening and fastening zippers on flaps extending across adjacent sides of the first and second compartments achieving opened and closed positions of the compartments for display and transport respectively.

10. The method of carrying and displaying cosmetics set forth in claim 9 including the step of providing at least one series of transparent exterior compartments on a back of an exterior of one of the first and second compartments.

11. The method of carrying and displaying cosmetics set forth in claim 9 including the step of fastening handle straps at opposed ends of respective backs of the first and second compartments.

* * * * *